US010986967B2

(12) United States Patent
Kimble

(10) Patent No.: US 10,986,967 B2
(45) Date of Patent: Apr. 27, 2021

(54) SANITARY BATHROOM ORGANIZER

(71) Applicant: Emeil Kimble, Westwego, LA (US)

(72) Inventor: Emeil Kimble, Westwego, LA (US)

( * ) Notice: Subject to any disclaimer, the term of this patent is extended or adjusted under 35 U.S.C. 154(b) by 105 days.

(21) Appl. No.: 16/424,269

(22) Filed: May 28, 2019

(65) Prior Publication Data

US 2019/0357739 A1 Nov. 28, 2019

Related U.S. Application Data

(60) Provisional application No. 62/676,724, filed on May 25, 2018.

(51) Int. Cl.

| | |
|---|---|
| ***A47K 17/00*** | (2006.01) |
| ***A47K 10/32*** | (2006.01) |
| *A47K 11/10* | (2006.01) |

(52) U.S. Cl.

CPC ..... *A47K 17/00* (2013.01); *A47K 10/32* (2013.01); *A47K 11/10* (2013.01)

(58) Field of Classification Search

CPC ..... A46B 17/06; A47K 3/23; A47K 10/32; A47K 11/10; A47K 17/00

USPC ..... 206/225, 233, 581

See application file for complete search history.

(56) References Cited

U.S. PATENT DOCUMENTS

| | | | | | |
|---|---|---|---|---|---|
| 4,280,643 | A * | 7/1981 | Cordova | A47K 5/04 | 206/225 |
| 5,035,321 | A * | 7/1991 | Denton | A47L 13/51 | 206/225 |
| 5,971,141 | A * | 10/1999 | Shafik | A47K 11/10 | 206/225 |
| 6,050,401 | A * | 4/2000 | Michaelson | A47K 17/00 | 206/225 |
| 6,135,276 | A * | 10/2000 | French | A47L 13/51 | 206/225 |
| 6,460,697 | B1 * | 10/2002 | Stevens | B25H 3/06 | 206/225 |
| 2019/0290078 | A1 * | 9/2019 | Moses | A47K 1/09 | |

FOREIGN PATENT DOCUMENTS

| | | | | |
|---|---|---|---|---|
| GB | 2232879 A * | 1/1991 | ..... | A46B 17/06 |

* cited by examiner

*Primary Examiner* — Bryon P Gehman

(57) ABSTRACT

A sanitary bathroom organizer is an apparatus that stores and houses bathroom cleaning tools and bathroom cleaning supplies in an organized and hygienic manner. The apparatus includes a reservoir, at least one slot, a toilet paper roll mount. The reservoir contains disinfectant solution and houses bathroom cleaning tools. The at least one slot allows bathroom cleaning tools to enter the reservoir. The toilet paper roll mount connects a roll of toilet paper with the apparatus. The reservoir includes a base plate, a lateral wall, and a lid. The base plate is positioned adjacent the lateral wall. The lateral wall is perimetrically connected with the base plate, effectively containing disinfectant solution. The lid is removably coupled with the lid, allowing the interior environment of the reservoir to be accessible. The at least one slot traverses through the lid in order for bathroom cleaning supplies to be housed within the reservoir.

20 Claims, 6 Drawing Sheets

SANITARY BATHROOM ORGANIZER

The current application claims priority to U.S. provisional application Ser. No. 62/676,724 filed on May 25, 2018. The current application is filed on May 28, 2019 while May 25, 2019 was on a weekend and while May 27, 2019 was on a national holiday (Memorial Day).

FIELD OF THE INVENTION

The present invention generally relates to organizers. More specifically, the present invention is a sanitary bathroom organizer.

BACKGROUND OF THE INVENTION

In present times, individuals are always looking for ways to compartmentalize toiletry tools/supplies in a sanitary way. In conventional systems, users would often rely on dedicated toilet tool holders, and/or separate storage compartments. These conventional systems oftentimes lead to improper sanitary storage of toiletry tools, and/or inconveniences of dragging along multiple toiletry tools. Additionally, conventional systems often lack the means providing a self-contained system for liquid disinfectant, which often leads to unintentional biohazard spillage of said contents, creating an unsanitary environment for bacterial growth on the site of the spillage.

The present invention aims to improve on these conventional systems by providing a practical and economical way to maintain a safe and healthy storage environment for toiletry tools that are arguably are subjected to some of the worst usages known to our society. The present invention was created to eliminate the biohazard mess often associated with biohazard spillages in conventional systems. The present invention is an improved sanitary storage system that not only prevents biohazard leakage, but also stores and dispenses toiletry media, and other types of loose articles.

DETAIL DESCRIPTIONS OF THE INVENTION

Figure 1:
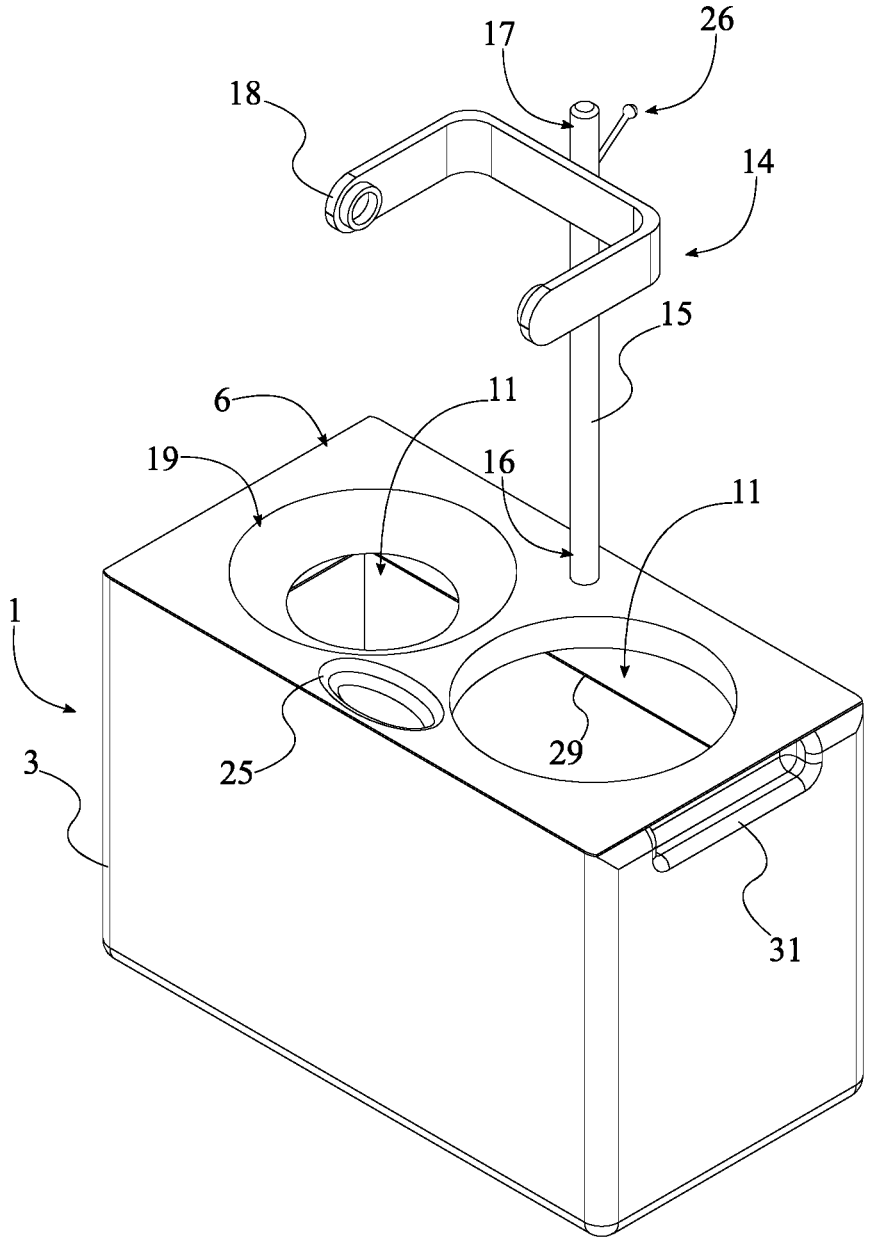
FIG. 1 is a top perspective view of a first embodiment of the present invention.

All illustrations of the drawings are for the purpose of describing selected versions of the present invention and are not intended to limit the scope of the present invention.

The present invention is a sanitary bathroom organizer that improves upon conventional storage of bathroom cleaning tools. The present invention prevents any leakage of liquid disinfectant that bathroom cleaning tools are submerged into in order to prevent the spread of germs. The present invention also provides easy accessibility to other commonly used bathroom tools. In order for the present invention to house bathroom tools in an organized manner, the present invention comprises a reservoir 1, at least one slot 11, and a toilet paper roll mount 14, seen in FIG. 1, FIG. 3, FIG. 4, FIG. 5, and FIG. 6. The reservoir 1 contains disinfectant solution and houses bathroom cleaning tools such as a toilet bowl brush and a toilet bowl plunger. The reservoir 1 contains disinfectant solution as the reservoir 1 comprises a base plate 2 and a lateral wall 3. The reservoir 1 further comprises a lid 6. The lid 6 encloses any bathroom cleaning tools positioned within the reservoir 1. Bathroom cleaning tools access the reservoir 1 through the at least one slot 11. Each slot preferably accommodates an individual bathroom cleaning. The toilet paper roll mount 14 upholds a toilet paper roll and distances the toilet paper roll from the reservoir 1 in order to prevent the toilet paper roll from becoming contaminated with disinfectant solution and germs from the bathroom cleaning tools. In order for a toilet paper roll to be securely mounted by the toilet paper roll mount 14, the toilet paper roll mount 14 comprises a post 15 and a roll-receiving frame 18. In the preferred embodiment of the present invention, the roll-receiving frame 18 is a clamp with a connecting plate, a first arm, a second arm, a first shaft, and a second shaft. The connecting plate connects the first arm and the second arm with each other. A toilet paper roll is rotatably connected between the first arm and the second arm with the first shaft and the second shaft. It is understood various embodiments of the present invention may comprise a roll-receiving frame 18 with a variety of roll retaining means.

Figure 2:
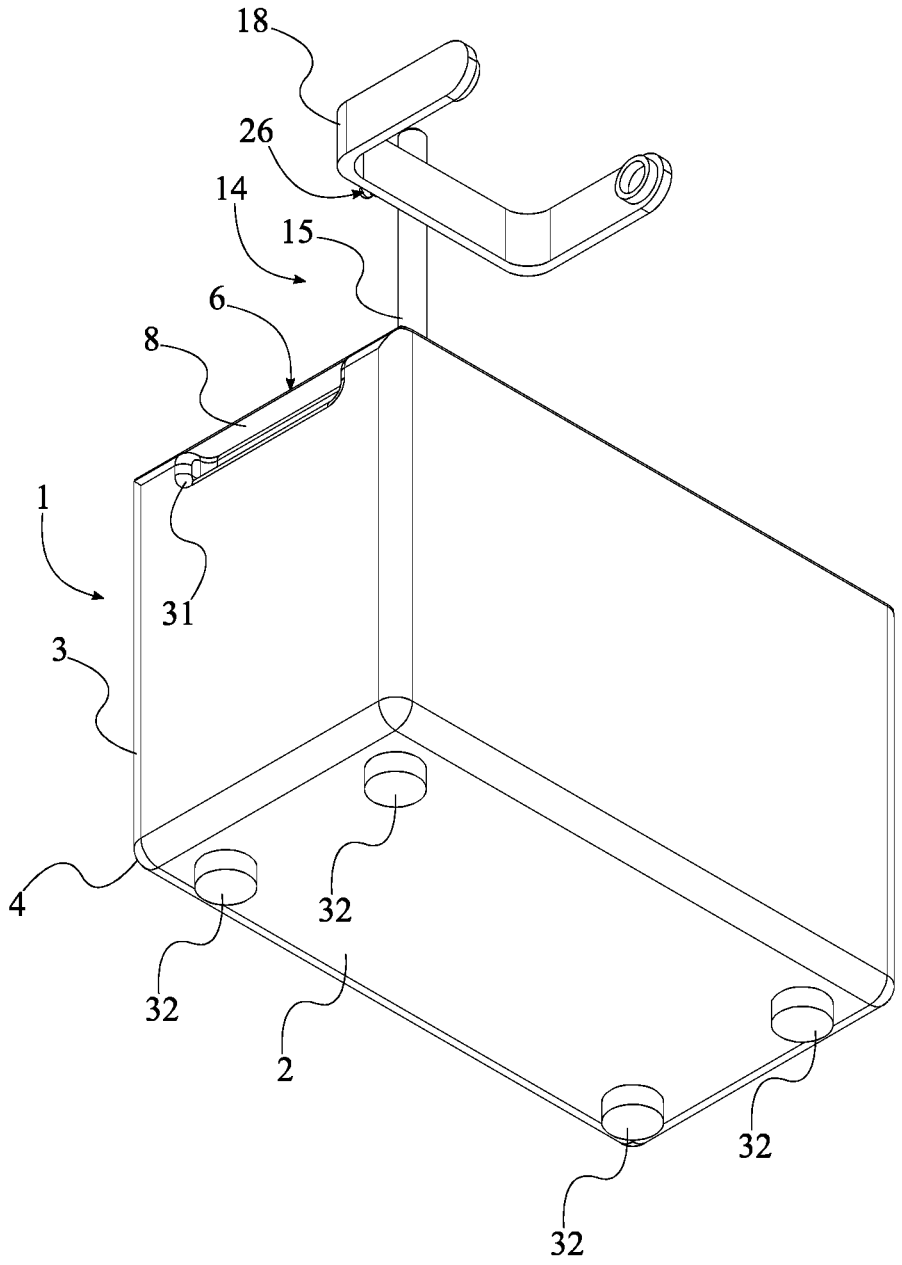
FIG. 2 is a bottom perspective view of the first embodiment of the present invention.

The overall configuration of the aforementioned components allows bathroom cleaning tools to be stored in a safe manner and bathroom supplies to be easily accessible. Disinfectant solution is safely stored within the reservoir 1 as the base plate 2 is positioned adjacent the lateral wall 3, seen in FIG. 2 and FIG. 5. A first reservoir rim 4 of the lateral wall 3 is perimetrically connected with the base plate 2, ensuring disinfectant solution within the reservoir 1 is sealed. Similarly, a second reservoir rim 5 of the lateral wall 3 is positioned opposite the first reservoir rim 4 across the lateral wall 3. A main opening 10 of the reservoir 1 is delineated by the second reservoir rim 5. The reservoir 1 is easily refilled with disinfectant solution and disinfectant solution within the reservoir 1 is changed through the main opening 10. The lid 6 traverses across the main opening 10 in order to effectively house and conceal bathroom cleaning tools positioned within the reservoir 1. The lid 6 is removably coupled with the second reservoir rim 5 so that the main opening 10 remains accessible. Bathroom cleaning tools are positioned within the reservoir 1, through the lid 6, as the at least one slot 11 traverses through the lid 6. A toilet paper roll is safely attached with the present invention as the post 15 is mounted adjacent to the reservoir 1. Furthermore, the roll-receiving frame 18 is terminally connected to the post 15, offset from the reservoir 1. This arrangement allows a toilet paper roll to be easily accessed by a user while using the bathroom.

Figure 3:
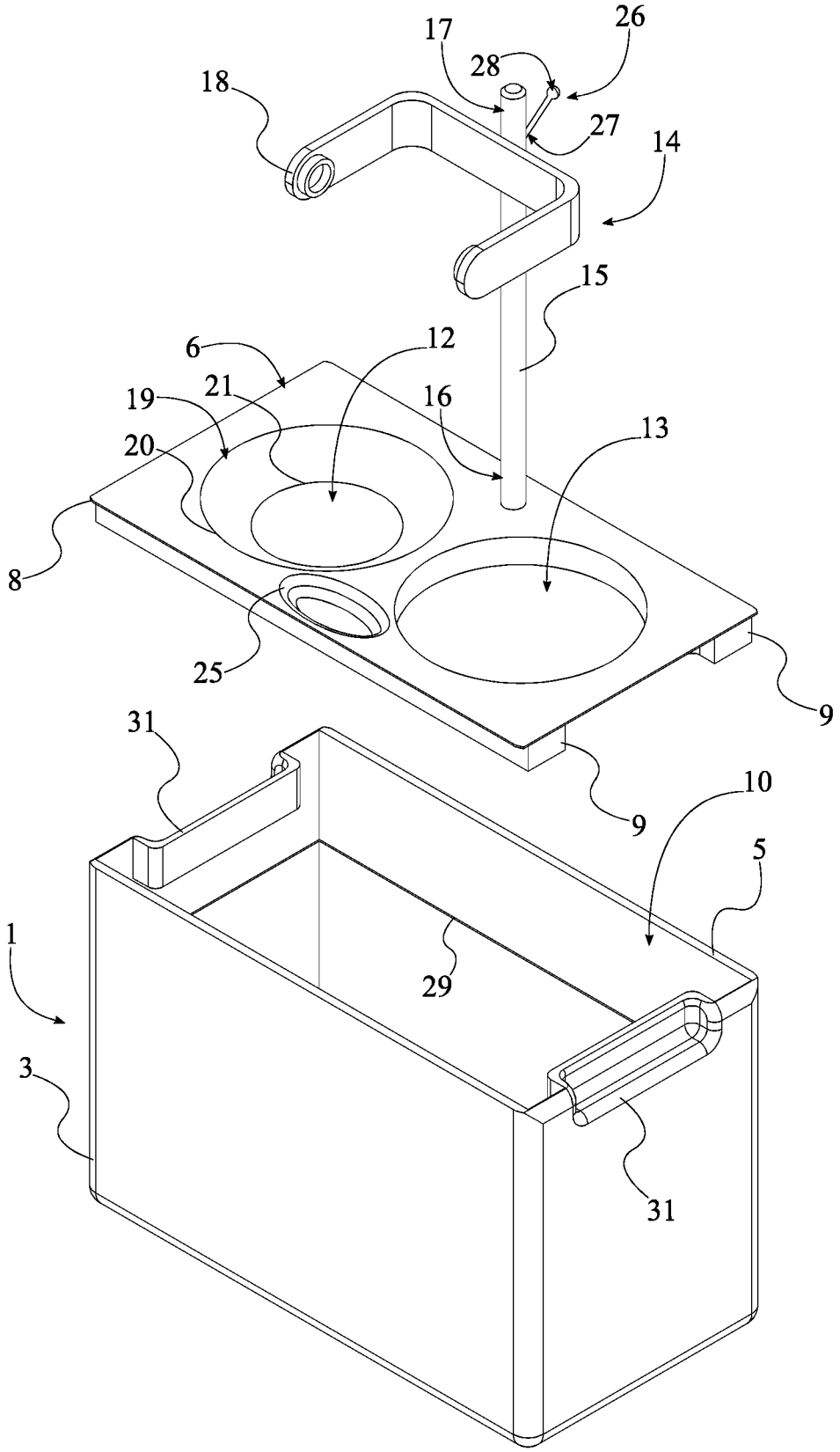
FIG. 3 is an exploded view of the first embodiment the present invention.
Figure 4:
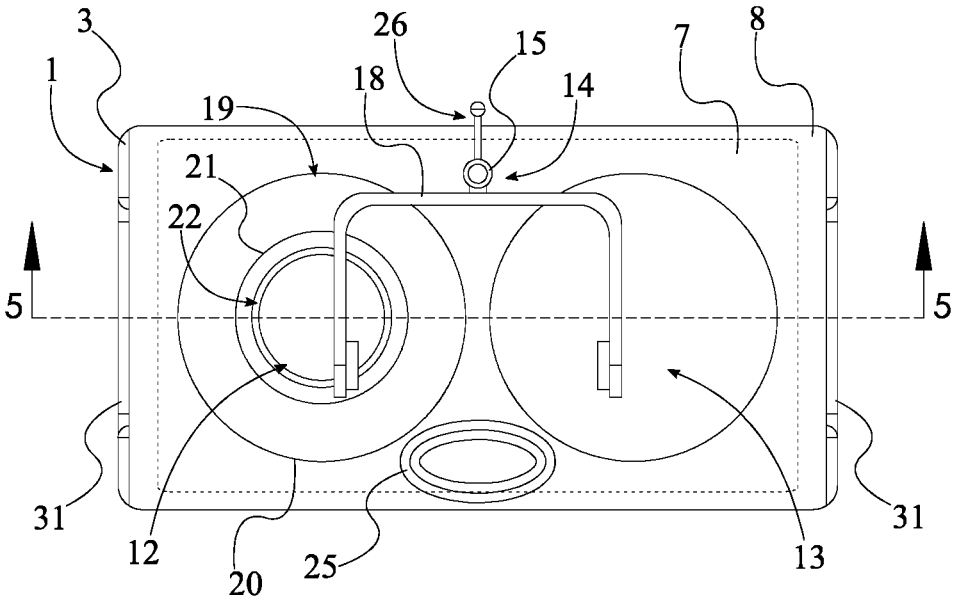
FIG. 4 is a top side of the first embodiment the present invention.
Figure 5:
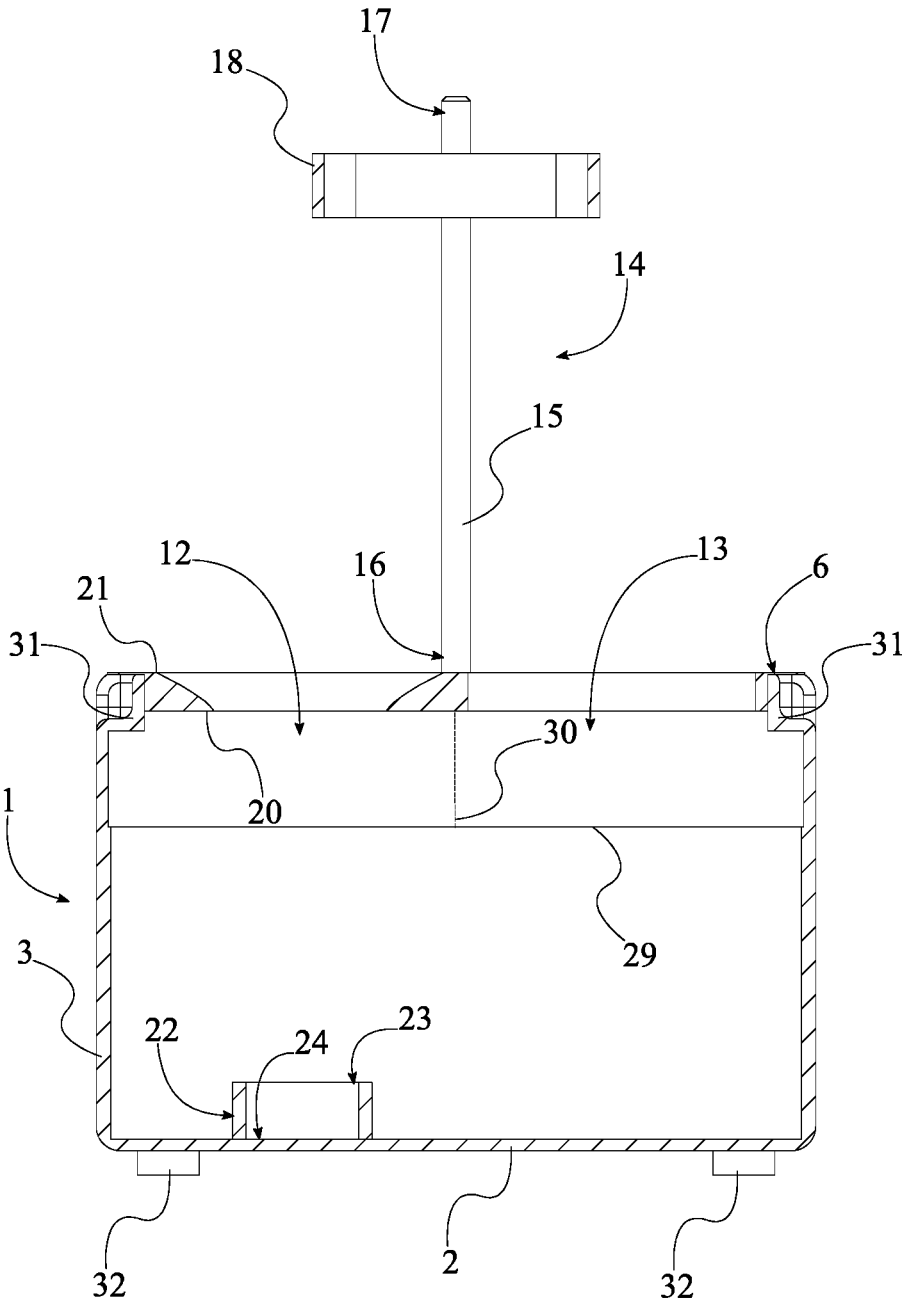
FIG. 5 is a cross-section view of FIG. 4 along line 5-5 the present invention.
Figure 6:
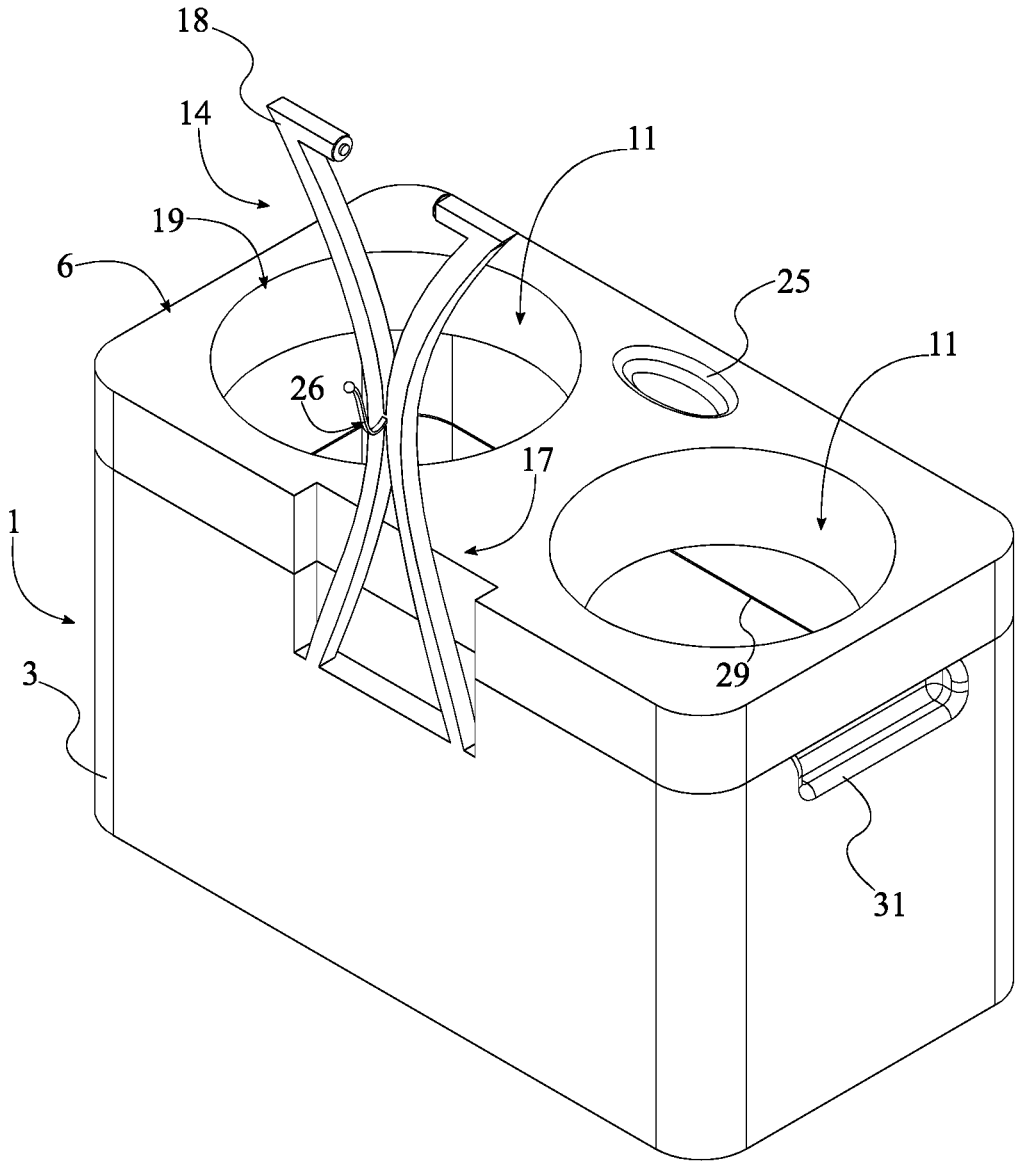
FIG. 6 is a rear perspective view of a second embodiment of the present invention.

In the preferred embodiment of the present invention, the at least one slot 11 comprises a first slot 12 and a second slot 13, seen in FIG. 3, FIG. 4, and FIG. 5. The first slot 12 and the second slot 13 each position and retain a bathroom cleaning tool. More specifically, the first slot 12 accommodates a toilet bowl brush, and the second slot 13 accommodates a toilet bowl plunger. The first slot 12 is positioned offset from the second slot 13. In order for the first slot 12 to preserve the cleanliness of the present invention and the bathroom cleaning tool being retained by the first slot 12, the present invention further comprises an annular scraper 19. The annular scraper 19 comprises a first scraper rim 20 and a second scraper rim 21. The first scraper rim 20 is connected around the first slot 12. More specifically, the annular scraper 19 tapers from the first scraper rim 20 to the second scraper rim 21. This arrangement forces the bristles of a toilet bowl brush to scratch along the second scraper rim 21 while removing the toilet bowl brush from the reservoir 1, forcing any residue to remain within the reservoir 1.

As a toilet bowl brush may not have a planar base, unlike a toilet bowl plunger, the present invention further comprises a tubular housing 22 in order to orient and secure the position of the toilet bowl brush within the first slot 12, shown in FIG. 4 and FIG. 5. The tubular housing 22 comprises an open end 23 and a closed end 24. The open end 23 allows a bathroom cleaner tool, preferably a toilet bowl brush, to be positioned within the tubular housing 22. The closed end 24 upholds the toilet bowl brush within the reservoir 1. As a brush end of the toilet bowl brush is positioned within the reservoir 1, the tubular housing 22 is positioned within the reservoir 1. The tubular housing 22 is positioned concentric to the first slot 12, effectively orienting a handle of the toilet bowl brush directly out of the first slot 12. More specifically, the closed end 24 is connected onto the base plate 2, and the open end 23 is oriented towards the main opening 10.

The present invention further accommodates bathroom cleaning tools as the preferred embodiment of the present invention comprises a receptacle 25, seen in FIG. 1, FIG. 3, FIG. 4, and FIG. 6. The receptacle 25 houses smaller bathroom cleaning supplies such as toilet bowl tablets. The receptacle is integrated into the lid 6, opposite to the main opening 10, and is positioned offset from the at least one slot 11. An alternate embodiment of the present invention may further comprise a cover may be hingedly connected adjacent the receptacle 25. In this alternate embodiment of the present invention, the cover conceals any bathroom cleaning supply housed within the receptacle 25.

In order for the lid 6 to securely enclose the reservoir 1, the lid 6 comprises a main plate 7, a lip 8, and a pair of elongated tabs 9, seen in FIG. 3. The main plate 7 covers the main opening 10 of the reservoir 1. The lip 8 upholds the main plate 7 against the lateral wall 3 of the reservoir 1. The pair of elongated tabs 9 reinforces the position and connection of the lid 6 with the lateral wall 3. The lip 8 is perimetrically connected around the main plate 7 so that the main plate 7 is balanced on top of the lateral wall 3. The pair of elongated tabs 9 is positioned opposite each other across the main plate 7 and is connected onto the main plate 7. Moreover, the pair of elongated tabs 9 is positioned into the reservoir 1 so that the lid 6 may be engaged with the lateral wall 3. The lid 6 is securely connected with the lateral wall 3 as the pair of elongated tabs 9 is frictionally engaged with the lateral wall 3 of the reservoir 1. The lip 8 is positioned against the second reservoir rim 5, thereby positioning the main plate 7 across the entirety of the main opening 10.

In a first embodiment of the present invention, the toilet paper roll mount 14 is connected to the lid 6 of the reservoir 1, seen in FIG. 1, FIG. 3, and FIG. 5. The first embodiment ensures the cleanliness of a toilet paper roll connected with the roll-receiving frame 18 as the toilet paper roll mount 14 is completely separated from the lateral wall 3 while the lid 6 is separated, and the main opening 10 of the reservoir 1 is completely exposed. In order to position the toilet paper roll mount 14 accordingly, the post 15 comprises a proximal end 16 and a distal end 17. The proximal end 16 of this first embodiment is connected onto the lid 6, opposite the main opening 10 of the reservoir 1. More specifically, the post 15 is oriented normal to the lid 6. In a second embodiment of the present invention, the toilet paper roll mount 14 is connected to the lateral wall 3 of the reservoir 1, seen in FIG. 6. This arrangement allows lid 6 to be removed without moving a toilet paper roll that is connected with the roll-receiving frame 18. The proximal end 16 is externally connected to the lateral wall 3. A toilet paper roll is positioned a safe distance from the disinfectant solution and the contaminated ends of the bathroom cleaning tools as the post 15 is oriented towards the lid 6. Moreover, the distal end 17 is positioned offset from the lid 6.

The present invention further provides easy access to bathroom supplies as the present invention further comprises a hook 26, shown in FIG. 1, FIG. 2, FIG. 3, FIG. 4, and FIG. 6. The hook 26 preferably upholds an extra toilet paper roll. The hook 26 may suspend a variety of other bathroom cleaning tools that do not necessarily need to be submerged in disinfectant solution. The hook 26 comprises a fixed end 27 and a free end 28. The fixed end 27 is laterally connected to the post 15, and the free end 28 is oriented away from the reservoir 1. This arrangement allows a variety of bathroom supplies and tools to hang from the hook 26.

Any bathroom cleaning tools entering the reservoir 1 may increase the level of disinfectant solution within the reservoir 1. In order to prevent any overflow or excessive splash back of disinfectant solution within the reservoir 1, the present invention comprises a full-line ridge 29, shown in FIG. 1, FIG. 3, FIG. 5 and FIG. 6. The full-line ridge 29 is positioned within the reservoir 1 so that the disinfectant solution is easily compared with the full-line ridge 29 by as the disinfectant solution comes into direct contact with the full-line ridge 29. The full-line ridge 29 is integrated around the lateral wall 3, facilitating the measurement of disinfectant solution within the reservoir 1. The level of disinfectant solution prevents any overflow or excessive splash back as the full-line ridge 29 is positioned offset from the second reservoir rim 5 by a safe-fill distance 30.

The present invention further comprises a pair of handles 31, seen in FIG. 1, FIG. 2, FIG. 3, FIG. 4, FIG. 5, and FIG. 6. The pair of handles 31 allows the present invention to be easily maneuvered and transported. The pair of handles 31 is externally integrated into the lateral wall 3. The present invention is balanced through transportation as the pair of handles 31 is positioned opposite each other about the second reservoir rim 5. The present invention further comprises a plurality of legs 32. The plurality of legs 32 reinforces the desired position of the present invention against the ground or comparable surface within a bathroom. More specifically, the plurality of legs 32 increases the friction between the ground and the reservoir 1. The plurality of legs 32 is connected onto the base plate 2, opposite the lateral wall 3 in order for the plurality of legs 32 to come into direct contact with the ground. The reservoir 1 is balanced with the plurality of legs 32 as the plurality of legs 32 is perimetrically distributed about the base plate 2.

Although the invention has been explained in relation to its preferred embodiment, it is to be understood that many other possible modifications and variations can be made without departing from the spirit and scope of the invention as hereinafter claimed.

What is claimed is:

1. A sanitary bathroom organizer comprises:

a reservoir;

at least one slot;

a toilet paper roll mount;

the reservoir comprises a base plate, a lateral wall, and a lid;

the toilet paper roll mount comprises a post and a roll-receiving frame;
the base plate being positioned adjacent the lateral wall;
a first reservoir rim of the lateral wall being perimetrically connected with the base plate;
a second reservoir rim of the lateral wall being positioned opposite the first reservoir rim across the lateral wall;
a main opening of the reservoir being delineated by the second reservoir rim;
the lid traversing across the main opening;
the lid being removably coupled with the second reservoir rim;
the at least one slot traversing through the lid;
the post being mounted adjacent to the reservoir; and,
the roll-receiving frame being connected to a terminal of the post;
the post being positioned in between the roll-receiving frame and the reservoir.

2. The sanitary bathroom organizer as claimed in claim 1 comprises:
the at least one slot comprises a first slot and a second slot.

3. The sanitary bathroom organizer as claimed in claim 2 comprises:
an annular scraper;
the annular scraper comprises a first scraper rim and a second scraper rim;
the first scraper rim being connected around the first slot; and,
the annular scraper tapering from the first scraper rim to the second scraper rim.

4. The sanitary bathroom organizer as claimed in claim 2 comprises:
a tubular housing;
the tubular housing comprises an open end and a closed end;
the tubular housing being positioned within the reservoir;
the tubular housing being positioned concentric to the first slot;
the closed end being connected onto the base plate; and,
the open end being oriented towards the main opening.

5. The sanitary bathroom organizer as claimed in claim 1 comprises:
a receptacle;
the receptacle being integrated into the lid, opposite to the main opening.

6. The sanitary bathroom organizer as claimed in claim 1 comprises:
the lid comprises a main plate, a lip, and a pair of elongated tabs;
the lip being perimetrically connected around the main plate;
the pair of elongated tabs being positioned opposite each other across the main plate;
the pair of elongated tabs being connected onto the main plate;
the pair of elongated tabs positioned into the reservoir;
the pair of elongated tabs being frictionally engaged with the lateral wall of the reservoir; and,
the lip being positioned against the second reservoir rim.

7. The sanitary bathroom organizer as claimed in claim 1 comprises:
the post comprises a proximal end and a distal end;
the proximal end being connected onto the lid, opposite the main opening of the reservoir; and,
the post being oriented normal to the lid.

8. The sanitary bathroom organizer as claimed in claim 1 comprises:
the post comprises a proximal end and a distal end;
the proximal end being externally connected to the lateral wall;
the post being oriented towards the lid.

9. The sanitary bathroom organizer as claimed in claim 1 comprises:
a hook;
the hook comprises a fixed end and a free end;
the fixed end being laterally connected to the post; and,
the free end being oriented away from the reservoir.

10. The sanitary bathroom organizer as claimed in claim 1 comprises:
a full-line ridge;
the full-line ridge being positioned within the reservoir;
the full-line ridge being integrated around the lateral wall; and,
a safe-fill distance being formed in between the full-line ridge and the second reservoir rim.

11. The sanitary bathroom organizer as claimed in claim 1 comprises:
a pair of handles;
the pair of handles being externally integrated into the lateral wall; and,
the pair of handles being positioned opposite each other about the second reservoir rim.

12. The sanitary bathroom organizer as claimed in claim 1 comprises:
a plurality of legs;
the plurality of legs being connected onto the base plate, opposite the lateral wall; and,
the plurality of legs being perimetrically distributed about the base plate.

13. A sanitary bathroom organizer comprises:
a reservoir;
at least one slot;
a toilet paper roll mount;
a full-line ridge;
a pair of handles;
the reservoir comprises a base plate, a lateral wall, and a lid;
the toilet paper roll mount comprises a post and a roll-receiving frame;
the base plate being positioned adjacent the lateral wall;
a first reservoir rim of the lateral wall being perimetrically connected with the base plate;
a second reservoir rim of the lateral wall being positioned opposite the first reservoir rim across the lateral wall;
a main opening of the reservoir being delineated by the second reservoir rim;
the lid traversing across the main opening;
the lid being removably coupled with the second reservoir rim;
the at least one slot traversing through the lid;
the post being mounted adjacent to the reservoir;
the roll-receiving frame being connected to a terminal of the post;
the post being positioned in between the roll-receiving frame and the reservoir;
the full-line ridge being positioned within the reservoir;
the full-line ridge being integrated around the lateral wall;
a safe-fill distance being formed in between the full-line ridge and the second reservoir rim;
the pair of handles being externally integrated into the lateral wall; and,
the pair of handles being positioned opposite each other about the second reservoir rim.

14. The sanitary bathroom organizer as claimed in claim 13 comprises:

an annular scraper;

a tubular housing;

the at least one slot comprises a first slot and a second slot;

the annular scraper comprises a first scraper rim and a second scraper rim;

the first scraper rim being connected around the first slot;

the annular scraper tapering from the first scraper rim to the second scraper rim;

the tubular housing comprises an open end and a closed end;

the tubular housing being positioned within the reservoir;

the tubular housing being positioned concentric to the first slot;

the closed end being connected onto the base plate; and, the open end being oriented towards the main opening.

15. The sanitary bathroom organizer as claimed in claim 13 comprises:

a receptacle;

the receptacle being integrated into the lid, opposite to the main opening.

16. The sanitary bathroom organizer as claimed in claim 13 comprises:

the lid comprises a main plate, a lip, and a pair of elongated tabs;

the lip being perimetrically connected around the main plate;

the pair of elongated tabs being positioned opposite each other across the main plate;

the pair of elongated tabs being connected onto the main plate;

the pair of elongated tabs positioned into the reservoir;

the pair of elongated tabs being frictionally engaged with the lateral wall of the reservoir; and, the lip being positioned against the second reservoir rim.

17. The sanitary bathroom organizer as claimed in claim 13 comprises:

the post comprises a proximal end and a distal end;

the proximal end being connected onto the lid, opposite the main opening of the reservoir; and, the post being oriented normal to the lid.

18. The sanitary bathroom organizer as claimed in claim 13 comprises:

the post comprises a proximal end and a distal end;

the proximal end being externally connected to the lateral wall;

the post being oriented towards the lid.

19. The sanitary bathroom organizer as claimed in claim 13 comprises:

a hook;

the hook comprises a fixed end and a free end;

the fixed end being laterally connected to the post; and, the free end being oriented away from the reservoir.

20. The sanitary bathroom organizer as claimed in claim 13 comprises:

a plurality of legs;

the plurality of legs being connected onto the base plate, opposite the lateral wall; and, the plurality of legs being perimetrically distributed about the base plate.

* * * * *